US007784755B1

(12) United States Patent
Johnson et al.

(10) Patent No.: US 7,784,755 B1
(45) Date of Patent: Aug. 31, 2010

(54) CLIP ASSEMBLY

(75) Inventors: Daniel Neal Johnson, Richfield, OH (US); Leonard Scott Lindner, Hudson, OH (US)

(73) Assignee: Cisco Technology, Inc., San Jose, CA (US)

( * ) Notice: Subject to any disclaimer, the term of this patent is extended or adjusted under 35 U.S.C. 154(b) by 299 days.

(21) Appl. No.: 11/679,685

(22) Filed: Feb. 27, 2007

(51) Int. Cl.
*A47B 96/06* (2006.01)

(52) U.S. Cl. ..... 248/220.21; 248/221.11; 403/80; 403/326

(58) Field of Classification Search ..... 248/220.22, 248/221.11, 222.11, 225.11, 222.12, 220.21; 403/321, 326, 340, 388, 61, 80; 52/665, 52/667, 668
See application file for complete search history.

(56) References Cited

U.S. PATENT DOCUMENTS 2,891,757 A * 6/1959 Lang ..... 248/225.11
3,297,345 A * 1/1967 Downing, Jr. ..... 403/326
3,545,712 A * 12/1970 Ellis ..... 248/222.11
4,705,255 A 11/1987 Reed, Jr.
5,966,893 A * 10/1999 Quillin ..... 52/713
7,264,211 B2 * 9/2007 Lindner et al. ..... 248/220.21
2006/0112659 A1 6/2006 Lindner et al.

* cited by examiner

*Primary Examiner*—Kimberly T Wood
(74) *Attorney, Agent, or Firm*—Tucker Ellis & West LLP

(57) ABSTRACT

A clip assembly having first and second clip members. In an example embodiment the first and second clip members are generally matching. Each clip member includes a mounting member adapted to envelope and slide along an edge of an associated mounting support, such as a ceiling T rail. Each clip member further includes a spacer member arranged generally parallel to the mounting member. The clip members are adapted to be mutually engaged by the engaging means included in respective spacer members when the first and second clip members are drawn together as a result of the respective mounting members sliding toward each other along opposed edges of the mounting support. The clip assembly is secured to the mounting support by an external screw and capable of being easily released from it, when necessary.

20 Claims, 6 Drawing Sheets

CLIP ASSEMBLY

BACKGROUND OF THE INVENTION

The subject application is directed to a clip assembly for mounting on an associated mounting support. More particularly, the subject application is directed to a mounting clip assembly and method for use with a suspended ceiling structure for mounting wireless access points.

In a typical wireless network environment, devices such as antennas, or access points, are affixed to ceilings. A variety of different ceiling types is employed by businesses, including drop-down or recessed ceiling grids. The typical drop down ceiling employs a network of T-rails. Access points are known to be mounted on the T-rail by using clips typically made of plastic, that grip either one edge, or opposing edges of the T-rails. However, currently used plastic clips are not secured to the T-rail and do not meet plenum requirements. Other previously known clips are complicated for manufacturing and difficult to install.

OVERVIEW OF EXAMPLE EMBODIMENTS

In accordance with an example embodiment, there is provided a clip assembly for mounting on an associated mounting support, including a first clip member and a second clip member. Each clip member includes a mounting member adapted to envelope and slide along an edge of a corresponding associated mounting support. Further included in each clip member is a spacer member arranged generally parallel to the mounting member. The spacer member is attached to at least a part of the mounting member and includes engaging means. The first and second clip members are adapted to be mutually engaged by the engaging means included in respective spacer members when the first and second clip members are drawn together as a result of the respective mounting members sliding toward each other along opposed edges of a corresponding associated mounting support. The clip assembly is further adapted to be secured to an associated mounting support. In an example embodiment, the first clip member generally matches the second clip member.

In accordance with an example embodiment described herein, an associated mounting support has a length in a first direction and a width in a second direction. The mounting member of each clip member is further elongated in the first direction and has a U shaped profile in the second direction. The mounting member further includes a first branch and a second branch, whereas both branches are extended in the second direction.

In an example embodiment, the spacer member of each clip member further includes a first plate and a second plate, the second plate being generally parallel to the first plate. The first and second plates of the spacer member are generally parallel to the branches of the mounting member. The first plate is attached to at least a part of the first branch of the mounting member and offset from the first branch in the second direction. The second plate includes a main portion and a tongue portion and is attached to at least a part of the first plate. The main portion of the second plate is located at a first preset distance from the first plate of the spacer member to form a first part of the spacer member. The tongue portion of the second plate is located at a second preset distance from the first branch of the mounting unit to form a second part of the spacer member.

In accordance with an example embodiment, the first part of the spacer member of the first clip member is adapted to slide into the second part of the spacer member of the second clip member. Further, the first part of the spacer member of the second clip member is adapted to slide into the second part of the spacer member of the first clip member.

In an example embodiment, the tongue portion of the second plate of the spacer member of the first clip member is adapted to slide over the main portion of the second plate of the spacer member of the second clip member. Further, the tongue portion of the second plate of the spacer member of the second clip member is adapted to slide over the main portion of the second plate of the spacer member of the first clip member.

In another example embodiment, the engaging means of each clip member further includes at least one protrusion comprised in at least one of the following: the main portion of the second plate of the spacer member, and the tongue portion of the second plate of the spacer member. The engaging means of each clip member further includes at least one first opening comprised in at least one of the following: the tongue portion of the second plate of the spacer member, and the main portion of the second plate of the spacer member. The at least one protrusion included in the spacer member of the first clip member is adapted to engage the at least one first opening included in the spacer member of the second clip member. The at least one first opening included in the spacer member of the first clip member is adapted to engage the at least one protrusion included in the spacer member of second clip member.

These and other aspects of the present invention are described herein in further detail, with reference to the accompanying drawings, the illustrated embodiments being representative of only some of the ways in which the principles and concepts of the invention can be executed and employed. Accordingly, the drawings and description will be regarded as illustrative in nature and not as restrictive.

DESCRIPTION OF EXAMPLE EMBODIMENTS

Figure 1:
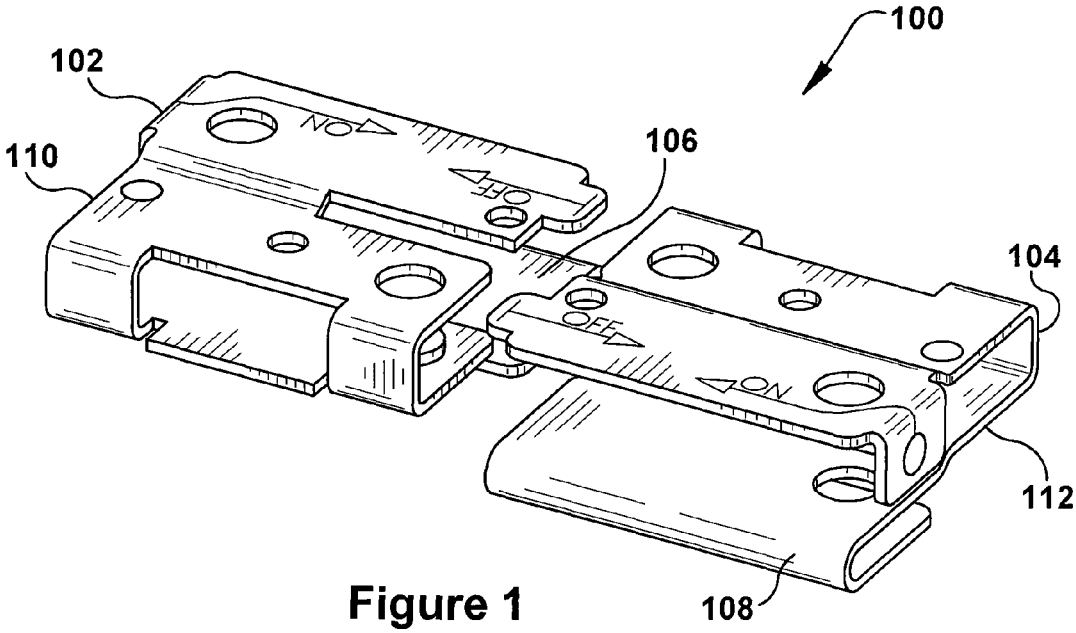
FIG. 1 is an exploded perspective view of a clip assembly in accordance with an example embodiment.

FIG. 1 shows an exploded perspective view of an example embodiment of a clip assembly 100. As illustrated in FIG. 1, the clip assembly 100 includes a first clip member 102 and a second clip member 104. The first clip member 102 generally matches the second clip member 104. Each clip member 102, 104 includes a mounting member 106, 108, respectively, adapted to envelope and slide along an edge of a corresponding associated mounting support (not shown in FIG. 1). Further included in each clip member 102, 104 is a spacer member 110, 112, respectively, arranged generally parallel to the mounting member 106, 108, respectively.

The spacer members 110, 112 in the clip members 102, 104, respectively, are attached each to at least a part of the respective mounting member 106, 108. The spacer members 110, 112 include engaging means which will be described further with reference to FIGS. 2A and 2B. The first and second clip members 102, 104, are, can be made of metal, such as, for example and without limitation, a steel sheet 032" thick with smooth coat and edge treatment. However, other suitable materials are capable of being used for manufacturing the clip members 102, 104, depending on desired or prescribed design factors, mechanical acceptance specifications, and the like.

As will be explained in greater detail below, the first clip member 102 and the second clip member 104 are adapted to be mutually engaged by the engaging means included in respective spacer members 110, 112 when the first and second clip members 102, 104 are drawn together as a result of the respective mounting members 106, 108 sliding toward each other along opposed edges of a corresponding associated mounting support. The clip assembly 100 is further adapted to be secured to an associated mounting support, as will be explained below.

Figure 2A:
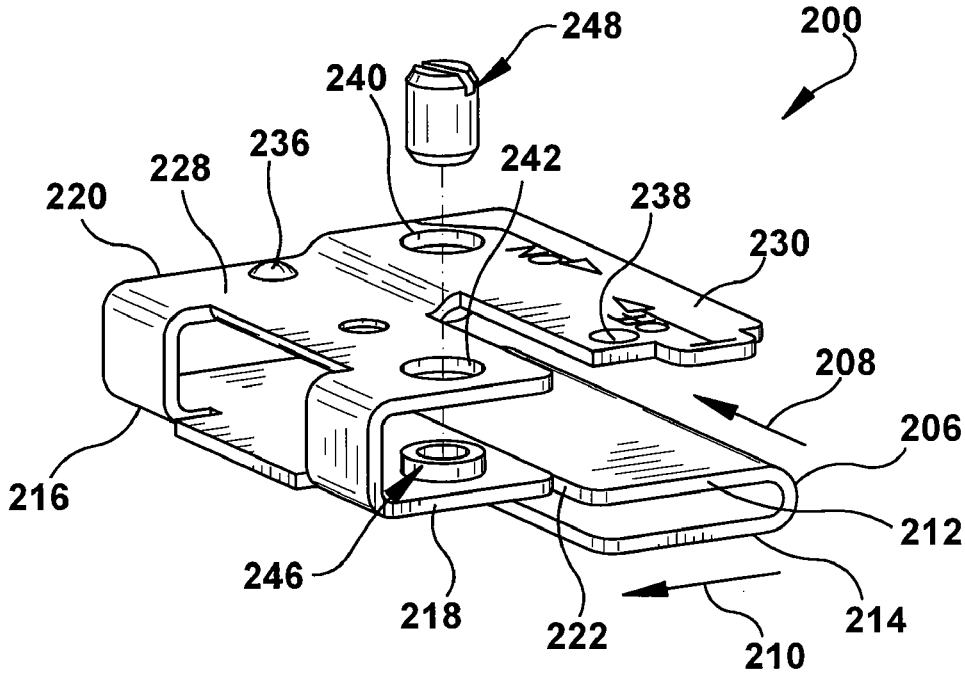
FIG. 2A is one perspective view of a clip member in accordance with an example embodiment.
Figure 2B:
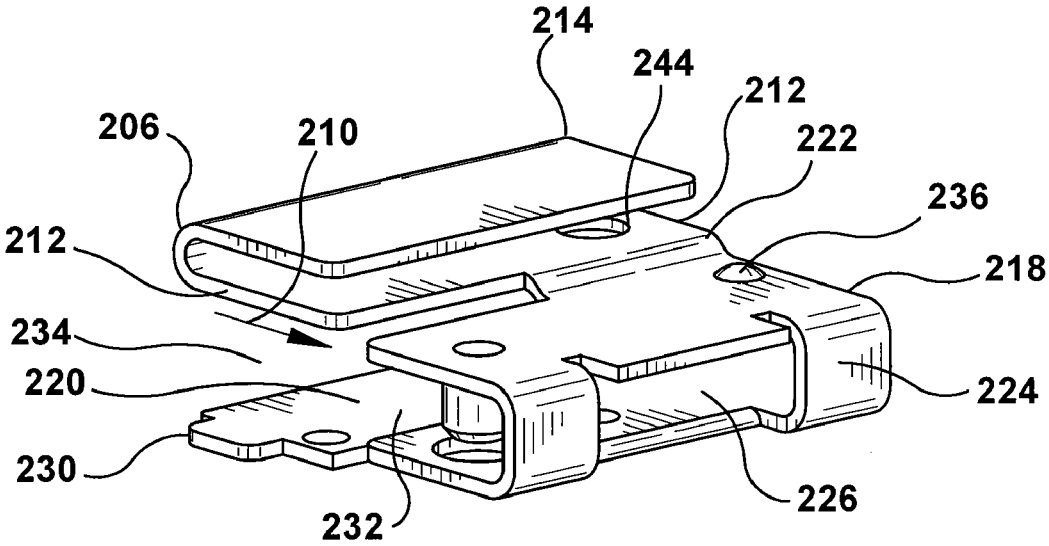
FIG. 2B is another perspective view of the clip member in accordance example embodiment.

FIGS. 2A and 2B show two perspective views of a clip member 200, which is analogous to clip members 102, 104. The clip member 200 illustrated in FIGS. 2A and 2B, the same as the clip members 102, 104, includes a mounting member 206 adapted to envelope and slide along an edge of a corresponding associated mounting support (not shown in the drawing). The associated mounting support, such as a T-rail, has a length in a first direction 208 and a width in a second direction 210. As illustrated in FIG. 2A, the mounting member 206 is elongated in the first direction 208 and has a U shaped profile in the second direction 210 and further includes a first branch 212 and second branch 214. The branches 212, 214 extend in the second direction 210.

The clip member 200 includes a spacer member 216 attached to the mounting member 206. The spacer member 216 includes a first plate 218 and a second plate 220 generally parallel to the first plate 218 and generally parallel to the branches 212, 214 of the mounting member 206. The first plate 218 of the spacer member 216 is attached to at least a part of an edge 222 of the first branch 212 of the mounting member 206 and offset from the edge 222 of the first branch 212 in the second direction 210, as shown in FIG. 2B.

The second plate 220 of the spacer member 216 is attached to at least a part of the first plate 218. As shown in FIG. 2B, the first and second plates 218, 220 of the spacer member 216 are bridged together by a bridge 224 such that the profile of the spacer member 216 opposed to the branches 212, 214 of the mounting member 206 is close-ended; and wherein the profile of the spacer member 216 facing the branches 212, 214 is open-ended.

The bridge 224 includes an aperture 226 (FIG. 2B) adapted to receive and/or engage an associated connecting device (not shown in the drawing) that is to be mounted onto the clip assembly including the clip 200. For example, the aperture 226 is capable of being used to mount an access point, wireless switch or any suitable device onto the clip 200 or with the aid of the clip assembly including the clip 200, when the assembly of the subject application is engaging and secured to an associated mounting support, such as a ceiling T-rail.

The second plate 220 includes a main portion 228 and a tongue portion 230. The main portion 228 of the second plate 220 is located at a first preset distance from the first plate 218 such as to form a first part 232 of the spacer member 216, as shown in FIG. 2B. The tongue portion 230 is located at a second preset distance from the first branch 212 of the mounting unit 206 such as to form a second part 234 of the spacer member 216.

As mentioned above, the clip member 200 represents the first and second clip members 102, 104. Thus, the first part 232 of the spacer member 216 of the first clip member 102 is adapted to slide into the second part 234 of the spacer member 216 of the second clip member 104. Further, the first part 232 of the spacer member 216 of the second clip member 104 is adapted to slide into the second part 234 of the spacer member 216 of the first clip member 102.

The tongue portion 230 of the second plate 220 of the spacer member 216 of the first clip member 102 is adapted to slide over the main portion 228 of the second plate 220 of the spacer member 216 of the second clip member 104. Further, the tongue portion 230 of the second plate 220 of the spacer member 216 of the second clip member 104 is adapted to slide over the main portion 228 of the second plate 220 of the spacer member 216 of the first clip member 102.

The spacer member 216 includes engaging means. The engaging means includes at least one protrusion included in at least one of the following: the main portion 228 of the second plate 220 of the spacer member 216, and the tongue portion 230 of the second plate 220 of the spacer member 216. The engaging means further includes at least one first opening included in at least one of the following: the tongue portion 230 of the second plate 220 of the spacer member 216, and the main portion 228 of the second plate 220 of the spacer member 216.

In the embodiment of the subject application as illustrated in FIGS. 2A and 2B, the engaging means includes a protrusion 236 included in the main portion 228 of the second plate 220, and a first opening 238 included in the tongue portion 230 of the second plate 220.

In the example embodiment of FIGS. 2A and 2B, the protrusion 236 and the first opening 238 are located in opposing ends of the second plate 220 of the spacer member 216. With reference to FIGS. 1, 2A, and 2B, the protrusion 236 included in the spacer member 216 of the first clip member 102 is adapted to engage the first opening 238 included in the spacer member 216 of the second clip member 104. Further, the first opening 238 included in the spacer member 216 of the first clip member 102 is adapted to engage the protrusion included in the spacer member 216 of second clip member 104.

In accordance with an example embodiment, each clip member 102, 104 represented in FIGS. 2A and 2B as the clip member 200, further includes at least one second opening, such as a second opening 240 (FIG. 2A) included in the tongue portion 230 of the second plate 220 of the spacer member 216, and at least one third opening such as a third opening 242 included in the main portion of the second plate 220 of the spacer member 216. Further included in the clip member 200 is at least one forth opening such as a fourth opening 244 (FIG. 2B) included in the first branch 212 of the mounting member 206.

Further included in the clip member 200 is at least one threaded opening, such as a threaded opening 246 (FIG. 2A) included in the first plate 218 of the spacer member 216. The threaded opening 246 is adapted to receive a corresponding external screw 248. The number of threads in the opening 246 depends on the thickness of the material used for the clip member 200, and typically is in the range of about 6-32. The forth opening 244 included in the first branch 212 of the mounting member 206 is coaxial with the second opening 240 included in the tongue portion 230 of the second plate 220 of the spacer member 216. The threaded opening 246 included in the first plate 218 of the spacer member 216 is coaxial with the third opening 242 included in the main portion of the second plate 220 of the spacer member 216.

Figure 3:
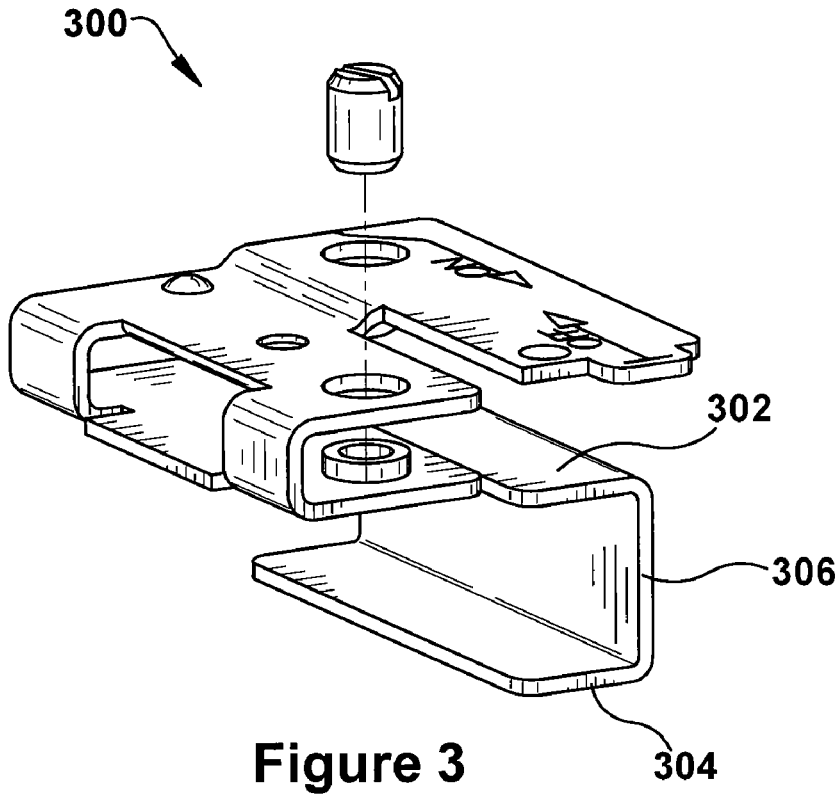
FIG. 3 is a perspective view of a clip member in accordance with an example embodiment.

The first and second branches 212 and 214 of the mounting member 206 are arranged such as to conform to the style of an associated mounting support. The latter is illustrated by a clip member 300 shown in FIG. 3. As illustrated in FIG. 3, the clip member 300 includes elements analogous to those of the clip member 200 of FIG. 2. The only difference, as will be evident by comparing FIG. 2 and FIG. 3, is that the branches 302, 304 of the mounting member 306 in FIG. 3 are spaced apart and arranged such that the mounting member 306 conforms to another style of ceiling T-rails.

Figure 4:
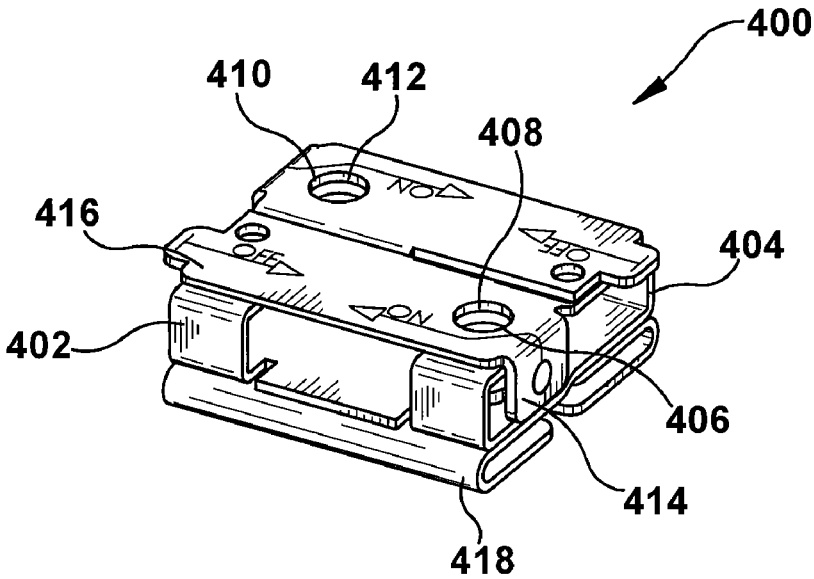
FIG. 4 illustrates a clip assembly with engaged clip members in accordance with example embodiment.

Reference will be now made to FIG. 4 illustrating a clip assembly 400 in accordance with the subject application. The clip assembly 400 includes a first clip member 402 and a second clip member 404 which are drawn together and are mutually engaged by the engaging means. The first and second clip members 402, 404 are analogous to the clip member 200 illustrated in FIG. 2.

Thus, with reference also to FIG. 2, the second opening 240, the third opening 242, the forth opening 244, and the threaded opening 246 are mutually arranged such that when the first clip member 402 and the second clip member 404 are mutually engaged by the engaging means, as illustrated in FIG. 4, the clip assembly 400 is adapted to be secured to an associated mounting support (not shown) through corresponding coaxial openings in the first and second clip members 402, 404 by at least one corresponding external screw 248 (not seen in FIG. 4).

When the first clip member 402 and the second clip member 404 are mutually engaged by the engaging means, as illustrated in FIG. 4, the second opening 406 (240 in FIG. 2A) in the second clip member 404 is coaxial with the third opening 408 (242 in FIG. 2A) in the first clip member 402. Further, the threaded opening (not seen in FIG. 4; 246 in FIG. 2A) in the first clip member 402 is coaxial with the fourth opening (not seen in FIG. 4; 244 in FIG. 2B) in the second clip member 404.

Still further, the second opening 410 (240 in FIG. 2A) in the first clip member 402 is coaxial with the third opening 412 (242 in FIG. 2A) in the second clip member 404. The threaded opening (not seen in FIG. 4; 246 in FIG. 2A) in the second clip member 404 is coaxial with the fourth opening (not seen in FIG. 4; 244 in FIG. 2B) in the first clip member 402.

Shown in FIG. 4 is a tab 414 included in the spacer member of the second clip member 404. As shown in FIG. 4, the tab 414 is attached to an end of the tongue portion 416 of the second plate of the spacer member. The tab 414 is attached generally perpendicular to the tongue portion 416 and extends toward the mounting member 418. The tab included in the spacer member of the first clip member 402 is not seen in the drawing. However, it is evident that the tab included in the spacer member of the first clip member 402 is attached analogous to the tab 414. The tabs included in the spacer members of the first and second clip members 402, 404 are capable of being used for assisting sliding of respective clip members 402, 404.

Figure 5:
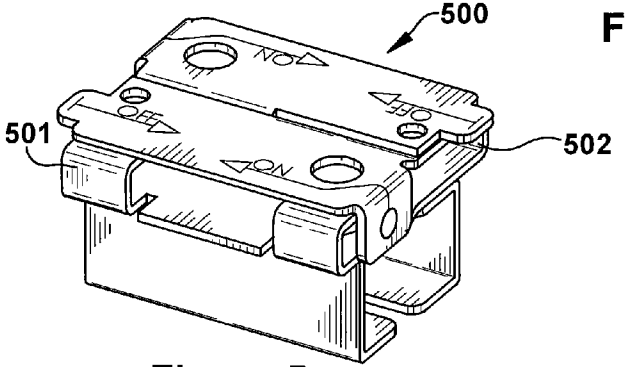
FIG. 5 illustrates a clip assembly with engaged clip members in accordance with an example embodiment.

FIG. 5 illustrates a clip assembly 500 in accordance with the subject application which is adapted for a T rail mounting support of a different style. The clip assembly 500 includes clip members 502, 504 analogous to that illustrated in FIG. 3. All the other features of the clip assembly 500 are analogous to those described above with reference to the clip assembly 400 as illustrated in FIG. 4.

Figure 6:
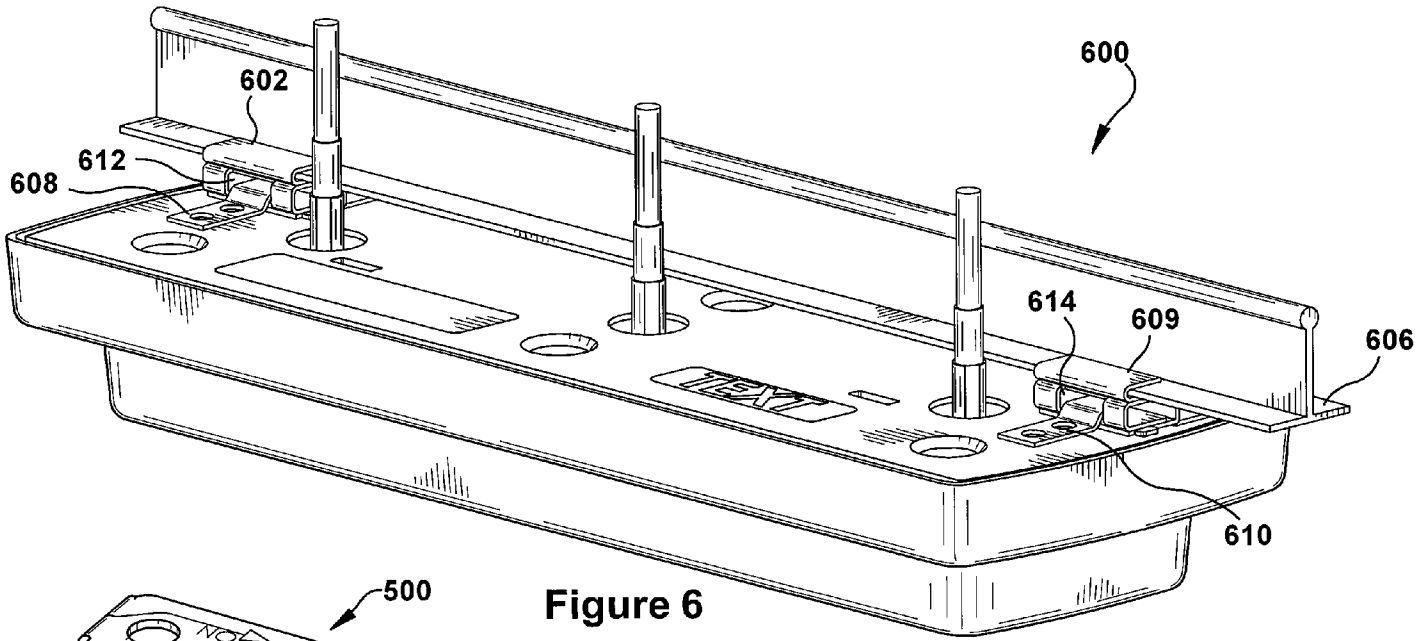
FIG. 6 illustrates an example embodiment of clip assemblies engaging a T rail mounting support of a first style, in accordance with one embodiment of the subject application.
Figure 7:
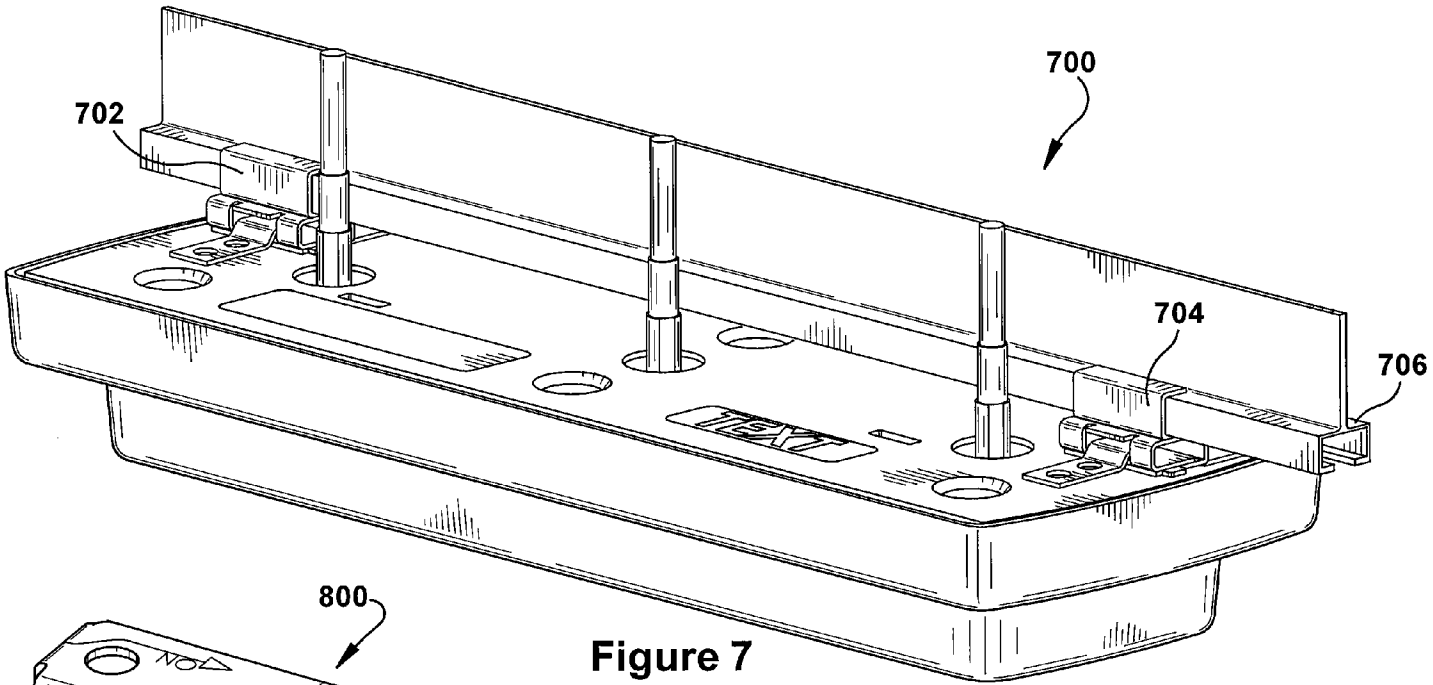
FIG. 7 illustrates an example embodiment of clip assemblies engaging a T rail mounting support of a second style, in accordance with an alternative embodiment of the subject application.

FIG. 6 and FIG. 7 are examples of clip assemblies engaging T rail mounting supports of two different styles, in accordance with the subject application. Thus, FIG. 6 is an example embodiment 600 employing clip assemblies 602, 604 analogous to that illustrated in FIGS. 1, 2, and 4. As illustrated in FIG. 6, the clip assemblies 602, 604 engage an associated mounting support 606. Respective associated connecting devices 608, 610 are received in respective apertures 612, 614 of the clip assemblies 602, 604.

FIG. 7 is an example embodiment 700 employing clip assemblies 702, 704 analogous to that illustrated in FIGS. 3 and 5. As illustrated in FIG. 7, the clip assemblies 702, 704 engage an associated mounting support 706, which is of a different style with respect to the mounting support 606 shown in FIG. 6. It is to be understood, that other styles of mounting supports are capable of being employed without departing from the scope of the subject application.

The clip assembly of the subject application is adapted to be unengaged manually or with the use of a suitable appliance or tool, such as, for example and without limitation, pliers, and the like.

Referring now to the method for securing a clip assembly to an associated T-rail in accordance with the subject application, the method will be explained with reference to FIGS. 1 through 8. The method begins with placing the first clip member 102 (FIG. 1) such that the mounting member 106 of the first clip member 102 envelopes a first edge of an associated T-rail (not shown in FIG. 1). An associated T-rail is, for example, such as illustrated in FIG. 6 as the mounting support 606. Next, the second clip member 104 including the mounting member 108 and the spacer member 112 is placed such that the mounting member 108 of the second clip member 104 envelopes a second edge of the associated T-rail. The second edge of an associated T-rail is opposed to the first edge of an associated T-rail, as shown in FIGS. 6, 7.

The method continues by sliding the first and second clip members 102, 104 toward each other along opposed first and second edges of a corresponding associated T-rail. The step of sliding includes sliding the tongue portion 230 (FIG. 2) included in the spacer member 110 of the first clip member 102 over a main portion 228 included in the spacer member 112 of the second clip member 104. The step of sliding further includes simultaneously sliding the tongue portion 230 included in the spacer member 112 of the second clip member 104 over a main portion 228 included in the spacer member 110 of the first clip member 102.

Figure 8:
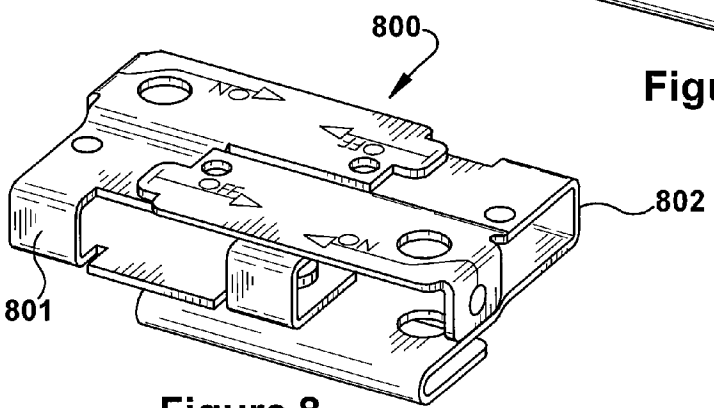
FIG. 8 illustrates an intermediate step of sliding the clip members toward each other in accordance with an example embodiment.

An intermediate step of sliding the first and second clip members 802, 804 toward each other is illustrated in FIG. 8. It will be understood that the first and second clip members 802, 804 as illustrated in FIG. 5 are analogous to the first and second clip members 102, 104 of FIG. 1.

Next, the first and second clip members 102, 104 are mutually engaged to form thereby a clip assembly, as illustrated by the clip assembly 400 in FIG. 4. As illustrated herein, the step of engaging includes engaging the protrusion 236 included in the spacer member 110 of the first clip member 102 with the first opening 238 included in the spacer member 112 of the second clip member 104. Simultaneously, the protrusion 236 included in the spacer member 112 of the second clip member 104 is engaged with the first opening 238 included in the spacer member 110 of first clip member 102.

The clip assembly 400 is then secured to an associated T-rail. The step of securing includes engaging at least one corresponding external screw, such as the external screw 248 shown in FIG. 2A, with an associated T-rail through corresponding coaxial openings comprised in the clip assembly 400. As described above with respect to FIG. 4, the second opening 406 (240 in FIG. 2A) in the second clip member 404 is coaxial with the third opening 408 (242 in FIG. 2A) in the first clip member 402. Further, the threaded opening (not seen in FIG. 4; 246 in FIG. 2A) in the first clip member 402 is coaxial with the fourth opening (not seen in FIG. 4; 244 in FIG. 2B) in the second clip member 404.

Still further, the second opening 410 (240 in FIG. 2A) in the first clip member 402 is coaxial with the third opening 412 (242 in FIG. 2A) in the second clip member 404. The threaded opening (not seen in FIG. 4; 246 in FIG. 2A) in the second clip member 404 is coaxial with the fourth opening (not seen in FIG. 4; 244 in FIG. 2B) in the first clip member 402.

The external screw, such as the external screw 248 shown in FIG. 2A, is capable of being inserted and engaged with the threaded opening 246 (shown in FIG. 2A) in advance, i.e. before the clip member 200 is placed to envelope an edge of an associated mounting support. In this embodiment, the external screw 248 is accessed through respective coaxial openings in the clip assembly 400 to be secured to an associated mounting support, as described in detail above.

In another embodiment, the external screw, such as the external screw 248, is capable of being inserted and engaged with the threaded opening 246 (shown in FIG. 2A) after the first and second clip members are mutually engaged forming thereby a clip assembly. Securing the clip assembly is then provided in the same manner as described above.

In the event that the ceiling structure includes T rails such as, for example, illustrated in FIG. 7 as the mounting support 706, the method in accordance with the subject application is carried out in the same manner as described above with respect to the mounting support 606 illustrated in FIG. 6. In this embodiment, clip members that conform to the associated mounting support 706 are used, such as, for example illustrated in FIG. 3 and FIG. 5.

Figure 9:
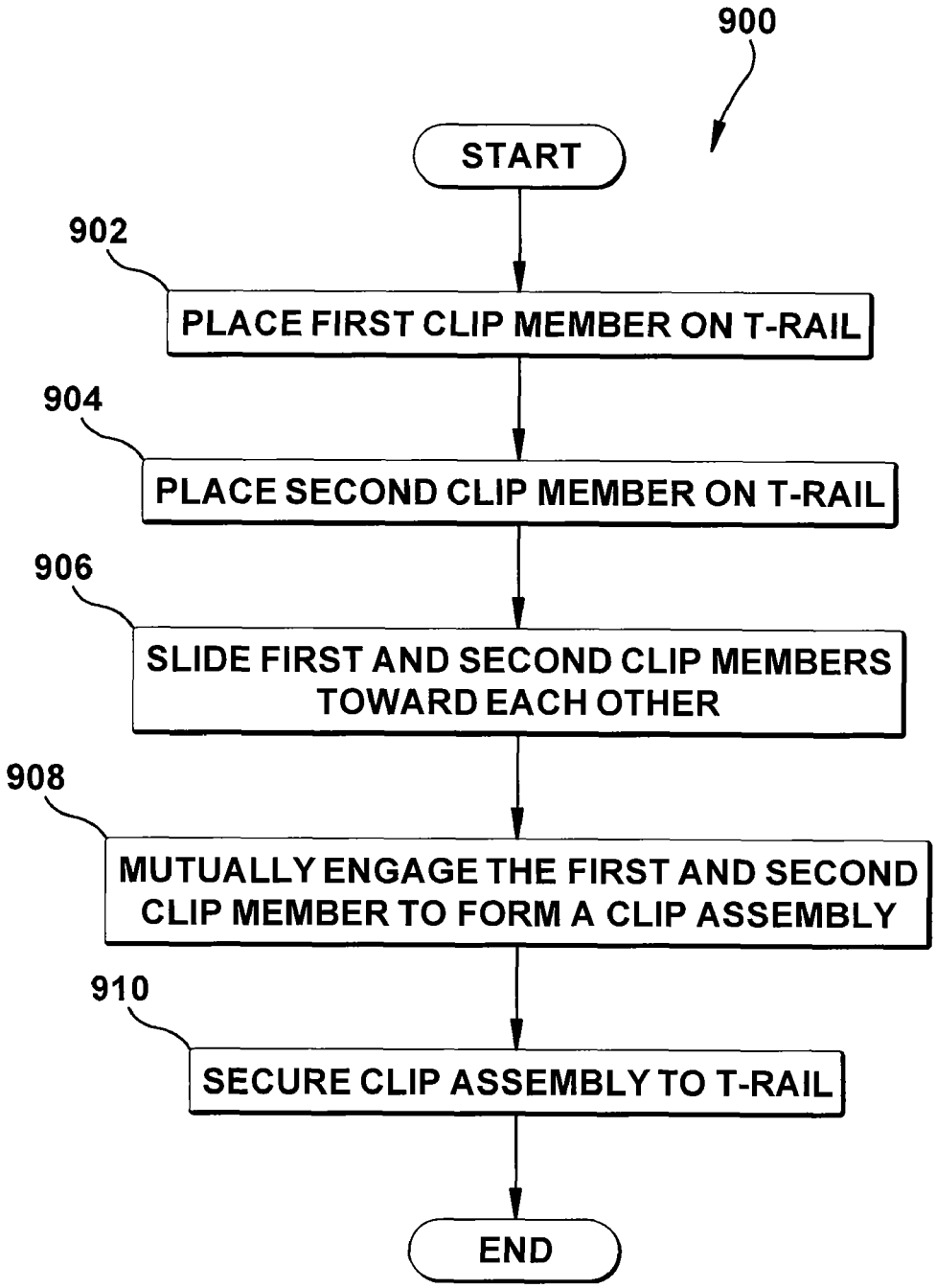
FIG. 9 is a flowchart illustrating a method for securing a clip assembly to an associated T-rail in accordance with an example embodiment.

Turning now to FIG. 9, there is shown a flowchart 900 illustrating the method for securing a clip assembly to an associated T-rail according to the subject application. Referring now to FIG. 9 with continued reference to FIGS. 1, 2, 4, 6, and 8, beginning at step 902, the first clip member 102 of FIG. 1 is placed such with respect to an associated T-rail, which is shown, for example, in FIG. 6 as the mounting support 606, that the mounting member 106 envelopes an edge of the associated T-rail.

At step 904, the second clip member 104 is placed such with respect to the associated T-rail, which is shown, for example, in FIG. 6 as the mounting support 606, that the mounting member 108 of the second clip member 104 envelopes an opposing edge of an associated T-rail. In an embodiment, when the clip members 402, 404 (FIG. 4) each include a tab, such as shown in FIG. 4 as the tab 414, attached to an end of the tongue portion 416 of the second plate of the spacer member, the clip members are placed such on the associated T-rail, that the tabs 414 are located at opposed ends of respective clip members. The tongue portions of the clip members are capable of including specific text and/or arrows, as shown, for example, in FIG. 1 and FIG. 4, to indicate the necessary orientation of respective clip members.

Once the first and second clip members 102, 104 are suitably placed on the associated T-rail, then at step 906, the first and second clip members are slid toward each other and drawn together such, as illustrated for clip members 801, 802 in FIG. 8. The clip members 801, 802 are capable of being pushed using, for example, respective tabs, such as the tab 414 shown in FIG. 4, since the clip members 801, 802 are adapted to slide along an associated T-rail, as described in detail above.

As previously addressed, the step of sliding, i.e. the step 906, includes sliding the tongue portion 230 (FIG. 2) included in the spacer member 110 of the first clip member 102 over a main portion 228 included in the spacer member 112 of the second clip member 104. The step 906 further includes simultaneously sliding the tongue portion 230 included in the spacer member 112 of the second clip member 104 over a main portion 228 included in the spacer member 110 of the first clip member 102.

Next, at step 908, the first and second clip members 102, 104 are continued to be pushed together until they are mutually engaged to form thereby a clip assembly, as illustrated by the clip assembly 400 in FIG. 4. As illustrated herein, the step of engaging includes engaging the protrusion 236 included in the spacer member 110 of the first clip member 102 with the first opening 238 included in the spacer member 112 of the second clip member 104. Simultaneously, the protrusion 236 included in the spacer member 112 of the second clip member 104 is engaged with the first opening 238 included in the spacer member 110 of first clip member 102.

At step 910 the clip assembly 400 is then secured to an associated T-rail. The step of securing includes engaging at least one corresponding external screw, such as the external screw 248 shown in FIG. 2A, with an associated T-rail through corresponding coaxial openings comprised in the clip assembly 400. Securing the clip assembly 400 prevents its movement along the associated T-rail. As described above, the external screw, such as the external screw 248 shown in FIG. 2A, is capable of being inserted and engaged with the threaded opening 246 (shown in FIG. 2A) in advance, i.e. before the clip member 200 is placed to envelope an edge of an associated mounting support. In this embodiment, the external screw 248 is accessed through respective coaxial openings in the clip assembly 400 to be secured to an associated mounting support, as described in detail above.

In another embodiment, the external screw, such as the external screw 248, is capable of being inserted and engaged with the threaded opening 246 (shown in FIG. 2A) after the first and second clip members are mutually engaged forming thereby a clip assembly. Securing the clip assembly is then provided in the same manner as described above.

The flowchart 900 is described herein with reference to 1, 2, 4, 6, and 8. However, the flowchart 900 equally illustrates the method in accordance with the subject application for an embodiment including the clip members configured as shown in FIGS. 3, 5, and 7.

The invention claimed is:

1. A clip assembly for mounting on an associated mounting support, comprising:

a first clip member and a second clip member, each clip member comprising a mounting member adapted to envelope and slide along an edge of a corresponding associated mounting support; and a spacer member arranged generally parallel to the mounting member, the spacer member being attached to at least a part of the mounting member and comprising an opening and a protrusion;

wherein the first and second clip members are configured to be mutually engaged by engaging the protrusion of the first clip member with the opening of the second clip member and the protrusion of the second clip member with the opening of the first clip member when the first and second clip members are drawn together as a result of the respective mounting members sliding toward each other along opposed edges of a corresponding associated mounting support;

wherein the clip assembly is configured to be secured to an associated mounting support wherein the spacer member of each clip member further comprises a first plate and a second plate, the first and second plates of the spacer member being generally parallel to the branches of the mounting member, wherein the first plate is attached to at least a part of the first branch of the mounting member and offset from the first branch in the second direction, wherein the second plate includes a main portion and a tongue portion and is attached to at least a part of the first plate, wherein the main portion of the second plate is located at a first preset distance from the first plate of the spacer member to form a first part of the spacer member, and wherein the tongue portion of the second plate is located at a second preset distance from the first branch of the mounting unit to form a second part of the spacer member;

wherein the first part of the spacer member of the first clip member is adapted to slide into the second part of the spacer member of the second clip member, and wherein the first part of the spacer member of the second clip member is adapted to slide into the second part of the spacer member of the first clip member; and wherein the tongue portion of the second plate of the spacer member of the first clip member is adapted to slide over the main portion of the second plate of the spacer member of the second clip member; and the tongue portion of the second plate of the spacer member of the second clip member is adapted to slide over the main portion of the second plate of the spacer member of the first clip member.

2. The clip assembly of claim 1, wherein the first clip member generally matches the second clip member.

3. The clip assembly of claim 1, wherein an associated mounting support has a length in a first direction and a width in a second direction, the mounting member of each clip member is further elongated in the first direction and has a U shaped profile in the second direction and further comprises a first branch and second branch, both branches being extended in the second direction.

4. The clip assembly of claim 1, wherein in each clip member the at least one protrusion and the at least one first opening are located in opposing ends of the second plate of the spacer member.

5. The clip assembly of claim 1, wherein each clip member further comprises:

at least one second opening comprised in the tongue portion of the second plate of the spacer member;

at least one third opening comprised in the main portion of the second plate of the spacer member;

at least one forth opening comprised in the first branch of the mounting member, the at least one forth opening being coaxial with the at least one second opening; and at least one threaded opening comprised in the first plate of the spacer member, the at least one threaded opening being coaxial with the at least one third opening;

wherein the at least one threaded opening is configured to receive and engage a corresponding external screw; and wherein the at least one second opening, the least one third opening, the at least one forth opening, and the at least one threaded opening are mutually arranged such that when the first clip member and the second clip member are mutually engaged, the clip assembly is adapted to be secured to an associated mounting support by the at least one corresponding external screw.

6. The clip assembly of claim 5, wherein when the first clip member and the second clip member are mutually engaged, the at least one second opening in the second clip member is coaxial with the at least one third opening in the first clip member, and the at least one threaded opening in the first clip member is coaxial with the at least one fourth opening in the second clip member; and wherein the at least one second opening in the first clip member is coaxial with the at least one third opening in the second clip member, and the at least one threaded opening in the second clip member is coaxial with the at least one fourth opening in the first clip member; and wherein the clip assembly is adapted to be secured to an associated mounting support by the at least one corresponding external screw through corresponding coaxial openings.

7. The clip assembly of claim 1, wherein in each clip member the first and second plates of the spacer member are bridged together by a bridge such that the profile of the spacer member opposed to the branches of the mounting member is close-ended; and wherein the profile of the spacer member facing the branches of the mounting member is open-ended.

8. The clip assembly of claim 7, wherein the bridge further includes an aperture adapted to receive an associated connecting device.

9. The clip assembly of claim 1, wherein first clip member and a second clip member are made of metal.

10. The clip assembly of claim 1, wherein an associated mounting support has a height in a third direction, and wherein the first and second branches of the mounting member are arranged such as to conform to the style of an associated mounting support.

11. The clip assembly of claim 1, wherein the spacer member further comprises a tab attached to an end of the tongue portion of the second plate of the spacer member, wherein the tab is attached generally perpendicular to the tongue portion of the second plate of the spacer member and extends toward the mounting member.

12. A clip assembly for mounting on an associated mounting support, comprising:

a first clip member and a second clip member, each clip member comprising a mounting member adapted to envelope and slide along an edge of a corresponding associated mounting support; and a spacer member arranged generally parallel to the mounting member, the spacer member being attached to at least a part of the mounting member and comprising an opening and a protrusion;

wherein the first and second clip members are configured to be mutually engaged by engaging the protrusion of the first clip member with the opening of the second clip member and the protrusion of the second clip member with the opening of the first clip member when the first and second clip members are drawn together as a result of the respective mounting members sliding toward each other along opposed edges of a corresponding associated mounting support;

wherein the clip assembly is configured to be secured to an associated mounting support;

wherein the spacer member of each clip member further comprises a first plate and a second plate, the first and second plates of the spacer member being generally parallel to the branches of the mounting member, wherein the first plate is attached to at least a part of the first branch of the mounting member and offset from the first branch in the second direction, wherein the second plate includes a main portion and a tongue portion and is attached to at least a part of the first plate, wherein the main portion of the second plate is located at a first preset distance from the first plate of the spacer member to form a first part of the spacer member, and wherein the tongue portion of the second plate is located at a second preset distance from the first branch of the mounting unit to form a second part of the spacer member; and wherein in each clip member the first and second plates of the spacer member are bridged together by a bridge such that the profile of the spacer member opposed to the branches of the mounting member is close-ended; and wherein the profile of the spacer member facing the branches of the mounting member is open-ended.

13. The clip assembly of claim 12, wherein the first clip member generally matches the second clip member.

14. The clip assembly of claim 12, wherein an associated mounting support has a length in a first direction and a width in a second direction, the mounting member of each clip member is further elongated in the first direction and has a U shaped profile in the second direction and further comprises a first branch and second branch, both branches being extended in the second direction.

15. The clip assembly of claim 12, wherein the first part of the spacer member of the first clip member is adapted to slide into the second part of the spacer member of the second clip member, and wherein the first part of the spacer member of the second clip member is adapted to slide into the second part of the spacer member of the first clip member.

16. The clip assembly of claim 15, wherein the tongue portion of the second plate of the spacer member of the first clip member is adapted to slide over the main portion of the second plate of the spacer member of the second clip member; and the tongue portion of the second plate of the spacer member of the second clip member is adapted to slide over the main portion of the second plate of the spacer member of the first clip member.

17. The clip assembly of claim 16, wherein each clip member further comprises:

at least one second opening comprised in the tongue portion of the second plate of the spacer member;

at least one third opening comprised in the main portion of the second plate of the spacer member;

at least one forth opening comprised in the first branch of the mounting member, the at least one forth opening being coaxial with the at least one second opening; and at least one threaded opening comprised in the first plate of the spacer member, the at least one threaded opening being coaxial with the at least one third opening;

wherein the at least one threaded opening is configured to receive and engage a corresponding external screw; and wherein the at least one second opening, the least one third opening, the at least one forth opening, and the at least one threaded opening are mutually arranged such that when the first clip member and the second clip member are mutually engaged, the clip assembly is adapted to be secured to an associated mounting support by the at least one corresponding external screw.

18. The clip assembly of claim 17, wherein when the first clip member and the second clip member are mutually engaged, the at least one second opening in the second clip member is coaxial with the at least one third opening in the first clip member, and the at least one threaded opening in the first clip member is coaxial with the at least one fourth opening in the second clip member; and wherein the at least one second opening in the first clip member is coaxial with the at least one third opening in the second clip member, and the at least one threaded opening in the second clip member is coaxial with the at least one fourth opening in the first clip member; and wherein the clip assembly is adapted to be secured to an associated mounting support by the at least one corresponding external screw through corresponding coaxial openings.

19. The clip assembly of claim 12, wherein in each clip member the at least one protrusion and the at least one first opening are located in opposing ends of the second plate of the spacer member.

20. The clip assembly of claim 12, wherein an associated mounting support has a height in a third direction, and wherein the first and second branches of the mounting member are arranged such as to conform to the style of an associated mounting support.

* * * * *